US005812908A

United States Patent [19]

Larocca et al.

[11] Patent Number: 5,812,908

[45] Date of Patent: Sep. 22, 1998

[54] CARBON FIBER ELECTRICAL CONTACT MOUNTING FOR ROTATING ELEMENTS

[75] Inventors: Andrew C. Larocca, Webster; Jeffrey W. Drawe, Rochester; Sharon R. Hagell, Honeoye Falls; Conrad J. Bell, Webster; Joseph A. Swift, Ontario; Stanley J. Wallace, Victor, all of N.Y.

[73] Assignee: Xerox Corporation, Stamford, Conn.

[21] Appl. No.: 826,813

[22] Filed: Mar. 25, 1997

[51] Int. Cl.[6] ..... G03G 15/00

[52] U.S. Cl. ..... 399/90

[58] Field of Search ..... 399/37, 88, 89, 399/90, 91, 168, 270, 285, 297, 354; 361/220, 221, 235; 439/92

[56] References Cited

U.S. PATENT DOCUMENTS

| | | | |
|---|---|---|---|
| 539,454 | 5/1895 | Thomson . | |
| 4,801,270 | 1/1989 | Scarlata | 439/92 X |
| 5,010,441 | 4/1991 | Fox et al. | 361/221 |
| 5,177,529 | 1/1993 | Schroll et al. | 399/91 X |
| 5,270,106 | 12/1993 | Orlowski et al. | 399/168 X |
| 5,354,607 | 10/1994 | Swift et al. | 428/294 |
| 5,410,386 | 4/1995 | Swift et al. . | |
| 5,420,465 | 5/1995 | Wallace et al. | 307/116 |
| 5,436,696 | 7/1995 | Orlowski et al. . | |
| 5,537,189 | 7/1996 | Imes . | |
| 5,606,722 | 2/1997 | Hart et al. | 399/270 |

*Primary Examiner*—Sandra L. Brase
*Attorney, Agent, or Firm*—John S. Wagley

[57] ABSTRACT

A device for transferring electrical charge from an electrically conductive element to a rotating element is provided. The device has a body including a pultruded composite member having a multiplicity of electrically conductive fibers provided with a polymer matrix. The plurality of conductive fibers is oriented within the polymer matrix in a longitudinal direction of the pultruded composite member. The fibers each extend in a substantially parallel direction, parallel to a first axis. The body includes a first contact area. The body defines an aperture therein. The body has a second contact area on the periphery of the aperture spaced from the first contact area and a support. The support is secured to the body for supporting the body. The first contact area is for contact with the conductive element and the second contact area is for contact with the rotating element. The fibrillated portion is coincident with at least one of the first contact area or said second contact area.

34 Claims, 6 Drawing Sheets

CARBON FIBER ELECTRICAL CONTACT MOUNTING FOR ROTATING ELEMENTS

This invention relates to electrostatographic printing machines, and, more particularly, to transferring electrical charge within an electrostatographic printing system.

Cross reference is made to the following application filed concurrently herewith: Attorney Docket Number D/96362 entitled "Carbon Fiber Electrical Contact for Rotating Elements" by Conrad J. Bell et al.

Generally, the process of electrostatographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles. The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The electrostatographic copying process uses electrical charge extensively to perform the many operations of the process. For example, charging, development, transfer, detacking, and cleaning, regularly use the transfer of charge and in particular electrostatic charge to facilitate these respective processes.

Often, the electrical charge needs to be transferred either to or from a rotating element. Two particular methods of transferring an electrical charge either to or from a rotating element include the use of a stationary brush in rubbing contact with a rotating member. In the past, such flexible electroconductive members included a flexible electrically conductive sheet, metal strip, or a metallic brush, such as a brush of fine copper wires.

More recently, an additional material has been utilized for transferring an electrical charge to a rotating member to substitute for the use of a brush of fine copper wires. The material used as such a replacement material is a series of conductive fibers as disclosed in U.S. Pat. No. 5,420,465 to Wallace et al, the relative portions thereof incorporated herein by reference. This type of contact has advantages over prior art electrically stranded brushes, but has several remaining disadvantages including the complexity of such structures as well as the space constraints related to the complexity of these contacts.

An alternate to the use of a flexible contacting member against a rotating shaft is the use of steel rotating element bearings filled with electrically conductive grease. While the use of such bearings to transfer an electrical charge to a shaft provides for a simpler and less base consumptive configurations, the electrical contact through such conductive grease is at best unreliable.

The following disclosures appear to be relevant:

U.S. Pat. No. 5,537,189

Patentee: Imes

Issued: Jul. 16, 1996

U.S. Pat. No. 5,436,696

Patentee: Orlowski, et al.

Issued: Jul. 25, 1995

U.S. Pat. No. 5,420,465

Patentee: Wallace et al.

Issued: May 30, 1995

U.S. Pat. No. 5,410,386

Patentee: Swift, et al.

Issued: Apr. 25, 1995

U.S. Pat. No. 5,354,607

Patentee: Swift, et al.

Issued: Oct. 11, 1994

U.S. Pat. No. 5,010,441

Patentee: Fox, et al

Issued: Apr. 23, 1991

U.S. Pat. No. 539,454

Patentee: Thomson

Issued: May 21, 1895

The relevant portions of the foregoing disclosures may be briefly summarized as follows:

U.S. Pat. No. 5,537,189 discloses a printing apparatus having a photosensitive member with an outer surface that has a conductive portion. A conductive brush including nonmetalic fibers is in contact with the conductive portion of the photosensitive member to provide an electrically conductive path to the member.

U.S. Pat. No. 5,436,696 discloses a fibrillated pultruded electronic component for grounding a photoconductor. The component makes electrical contact with the photoconductor. A laser is used to produce the fibrillated structure.

U.S. Pat. No. 5,420,465 discloses switches and sensors which utilize pultrusion contacts. The switches include pultruded contact members. The pultruded contact members have an insulating body and a plurality of conductive fibers carried within the insulating body. The pultruded contact member is fibrillated to expose the conductive fibers for establishing electrical contact.

U.S. Pat. No. 5,410,586 discloses an electroconductive contact that is formed of a pultruded member that has a hollow construction. The pultruded member includes a plurality of continuous electroconductive strands embedded in resin material. One end of the pultruded member has a laser fibrillated strand for contact with a photoconductive belt.

U.S. Pat. No. 5,354,607 discloses a static eliminator device which includes a nonmetalic pultruded composite member which has a plurality of conductive carbon fibers. The fibers are located in a polymer matrix of thermosetting resin. The carbon fibers are oriented in a longitudinal direction of the member and extend continuously throughout.

U.S. Pat. No. 5,010,441 discloses a device which electrically grounds a rotating shaft. A brush is mounted removably on the shaft. The brush has conductive fibers that extend outwardly over a portion thereof.

U.S. Pat. No. 539,454 discloses a commutator brush made of filimentary carbon coated with metal and mounted in a casing to strengthen it. The brush is composed of filimentary carbon connected together in layers or strips to the required thickness and size for the brush and united at one end and separate at the other end.

As will be seen from an examination of the cited prior art, it is desirable to provide an electrostatographic copying machine with a simple, in expensive and compact, as well as reliable device, to transfer an electrical charge to or from a rotating member. The present invention is intended to alleviate at least some of the aforementioned problems with the prior art.

In accordance with one aspect of the invention, there is provided a device for transferring electrical charge from an electrically conductive element to a rotating element. The device has a body including a pultruded composite member having a multiplicity of electrically conductive fibers provided with a polymer matrix. The plurality of conductive fibers is oriented within the polymer matrix in a longitudinal direction of the pultruded composite member. The fibers each extend in a substantially parallel direction, parallel to a first axis. The body includes a first contact area. The body defines an aperture therein. The body has a second contact area on the periphery of the aperture spaced from the first contact area and a support. The support is secured to the body for supporting the body. The first contact area is for contact with the conductive element and the second contact area is for contact with the rotating element. The fibrillated portion is coincident with the first contact area and/or the second contact area.

In accordance with a further aspect of the invention, there is provided a bearing for rotatably supporting a member in a housing and for transferring electrical charge between the housing and the member. The bearing includes a bearing outer race secured to the housing and a bearing inner race. The inner race is rotatably secured to the outer race and is secured to the member. The bearing also includes a seal having a pultruded composite member including a multiplicity of electrically conductive fibers provided with a polymer matrix. The plurality of conductive fibers are oriented within the polymer matrix in a longitudinal direction of the pultruded composite member. The fibers each extend in a substantially parallel direction, parallel to a first axis. The seal includes a first contact area on the outer periphery thereof. The seal defines an aperture therein. The seal includes a second contact area on the periphery of the aperture. The outer race cooperates with the first contact area and the inner race cooperates with the second contact area to transfer electrical charge between the housing and the member.

In accordance with another aspect of the present invention, there is provided a printing apparatus including an electrically conductive element and a rotating element. The printing apparatus includes a device for transferring electrical charge between the electrically conductive element and the rotating element. The device has a body including a pultruded composite member having a multiplicity of electrically conductive fibers provided with a polymer matrix. The plurality of conductive fibers is oriented within the polymer matrix in a longitudinal direction of the pultruded composite member. The fibers each extend in a substantially parallel direction, parallel to a first axis. The body includes a first contact area. The body defines an aperture therein. The body has a second contact area on the periphery of the aperture spaced from the first contact area and a support. The support is secured to the body for supporting the body. The first contact area is for contact with the conductive element and the second contact area is for contact with the rotating element. The fibrillated portion is coincident with at least one of the first contact area and the second contact area.

For a general understanding of the present invention, as well as other aspects thereof, reference is made to the following description and drawings, in which like reference numerals are used to refer to like elements, and wherein.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 1:
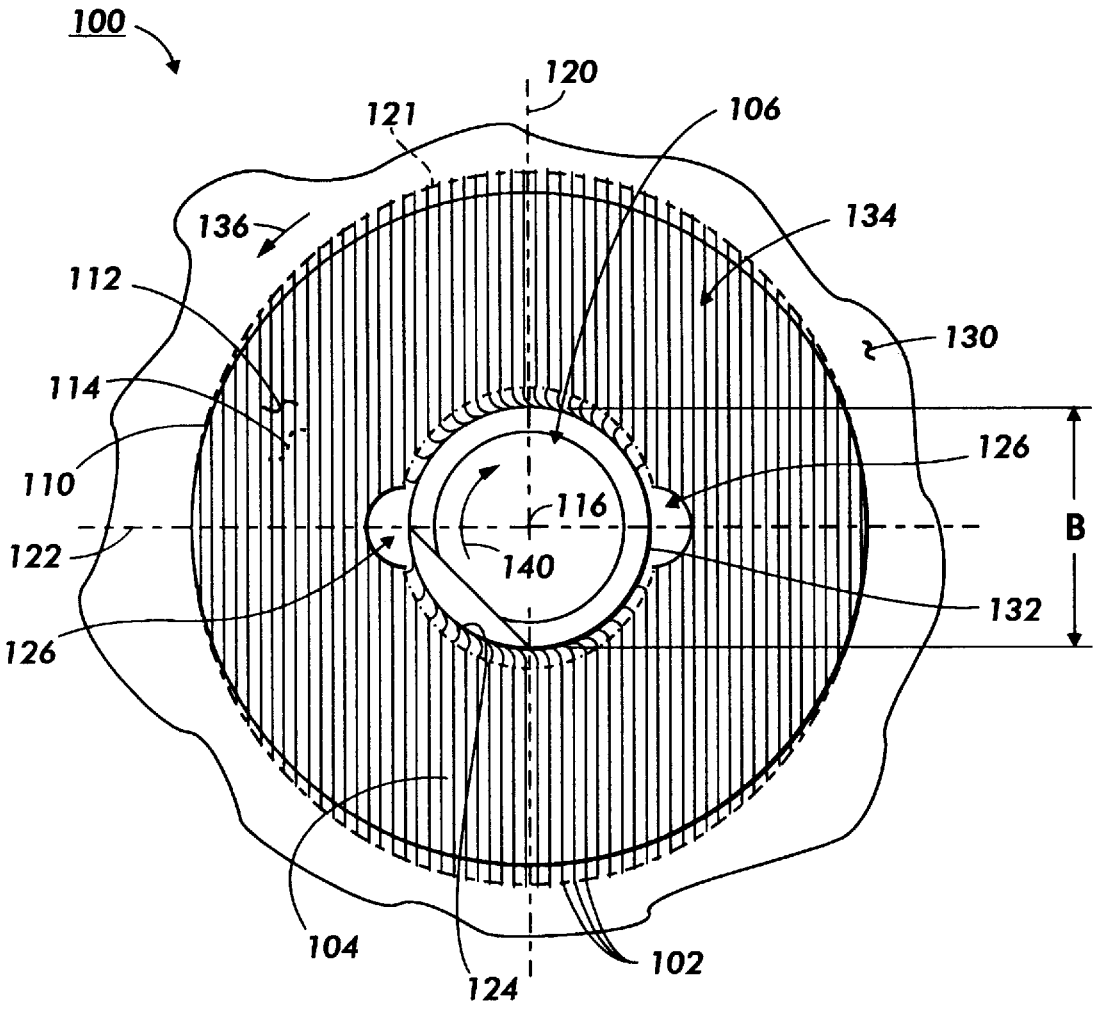
FIG. 1 is plan view of a device having a multiplicity of electrically conductive fibers extending in a parallel direction for transferring electrical charge according to the present invention.

Inasmuch as the art of electrostatographic processing is well known, the various processing stations employed in a typical electrostatographic copying or printing machine of the present invention will initially be described briefly with reference to FIG. 1. It will become apparent from the following discussion that the paper feeding system of the present invention is equally well suited for use in a wide variety of other electrophotographic or electronic printing systems, as for example, ink jet, ionographic, laser based exposure systems, etc.

Figure 6:
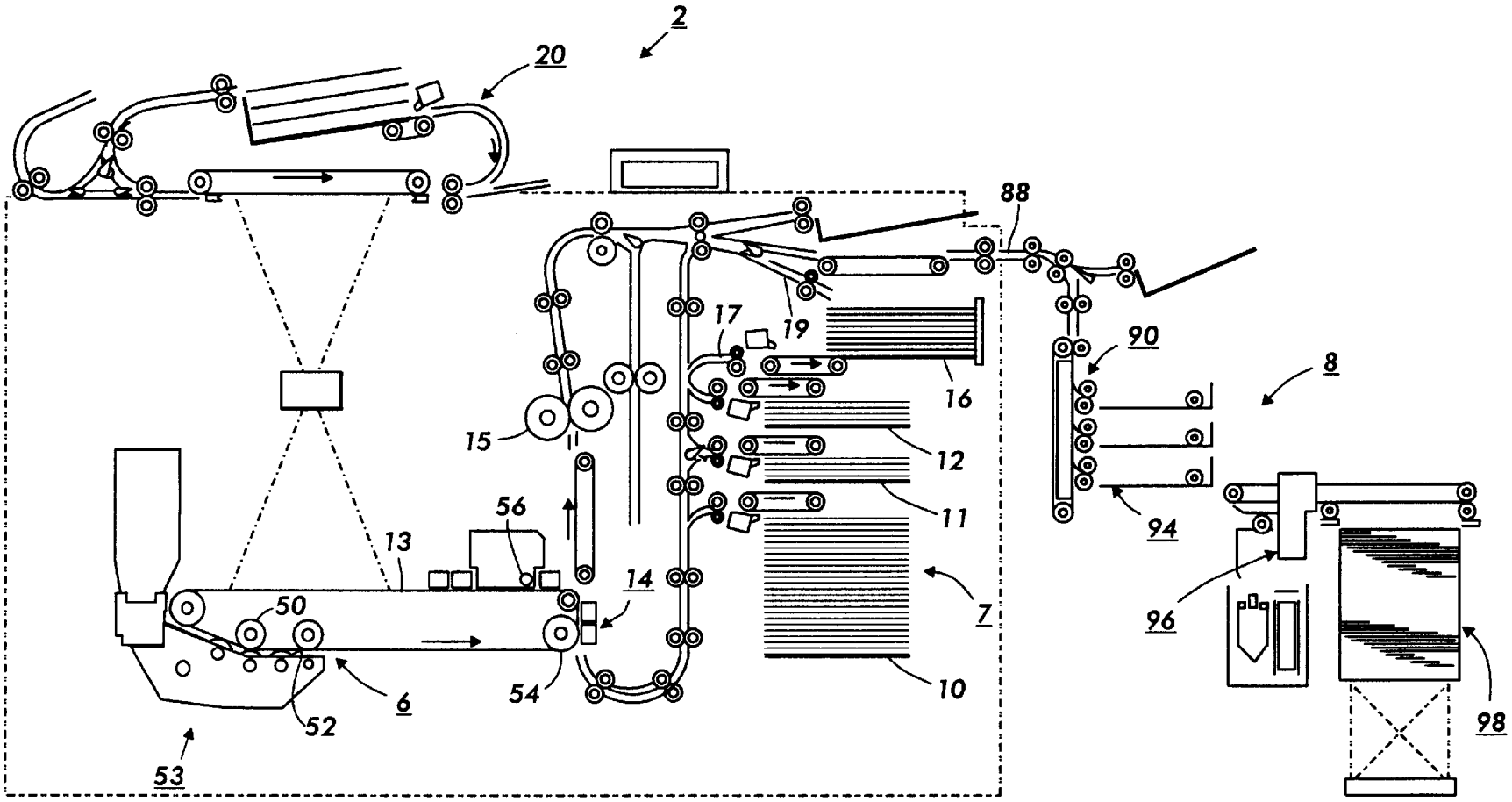
FIG. 6 is a schematic elevational view of a printing machine incorporating the electrical charge transferring devices of FIGS. 2A and 5A.

In FIG. 6, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 6 incorporates a recirculating document handler (RDH) 20 of a generally known type, which may be found, for example, in the well known Xerox Corporation model "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

Output path 88 is directly connected in a conventional manner to a bin sorter 90 as is generally known and as is disclosed in commonly assigned U.S. Pat. No. 3,467,371 incorporated in its entirety by reference herein. Bin sorter 90 includes a vertical bin array 94 which is conventionally gated (not shown) to deflect a selected sheet into a selected bin as the sheet is transported past the bin entrance. An optional gated overflow top stacking or purge tray may also be provided for each bin set. The vertical bin array 94 may also be bypassed by actuation of a gate for directing sheets serially onward to a subsequent finishing station. The resulting sets of prints are then discharged to finisher 96 which may include a stitcher mechanism for stapling print sets together and/or a thermal binder system for adhesively binding the print sets into books. A stacker 98 is also provided for receiving and delivering final print sets to an operator or to an external third party device.

Referring again to FIG. 6, the carbon fiber electrical contact for rotating the elements according to the present invention may be utilized in a varying number of applications within the printing machine 2. These applications include any element within the machine which requires a charge or an electrical bias to optimally perform. For example, an electrical charge can be provided to photoconductive belt 13 through backup roll 50. The carbon fiber electrical contact of the subject invention thus may be utilized on the backup roll 50.

Also, electrical bias can be transferred through developer roll 52 within developer unit 53. Likewise, the carbon fiber electrical contact of the present invention may be utilized to transfer electrical charge through the developer roll 52. Stripping roll 54 may likewise use the carbon fiber electrical contact to transfer electrical charge across the roll 54. Further, cleaning brush 56 may utilize the carbon fiber electrical contact to transfer electrical charge through the cleaning brush 56.

It should be appreciated that the locations of the backup roll 50, developer roll 52, detack roll 54 and cleaning brush 56 are merely examples of the possible applications for the carbon fiber electrical contact of the present invention. It should be appreciated that the electrical contact may be used anywhere where an electrical charge needs to be transferred between a rotating element and an adjacent fixed element.

The electrical contact of the present invention provides for greatly improved reliability, low cost and easy manufacture and are highly suitable to operate in low energy circuits. Typically these devices are low energy devices, using voltages within the range of millivolts to kilovolts. They may also use currents within the range of microamps to milliamps as opposed to high power applications that normally employ tens to hundreds of amperes at very high voltages, for example. Typically these devices are used where concern for the power dissipated at the interfacial surfaces is negligible, for example, in the cases where high voltages (in kilovolts) are coupled with microampere currents, or, at low voltage, ie. logic levels and currents in the tens of milliampere range. Although the present invention may be used in certain applications in the single amp to tens of amps region it is noted that best results are obtained in high or low voltage, low energy circuitry where power losses can be tolerated. It is also noted that these devices may be used in certain applications in the high voltage region in excess of 10,000 volts, for example, where excessive heat is not generated. These devices can be characterized as generally electronic in nature within the generic field of electrical devices meaning that their principle applications are in certain low power applications where their inherent power losses may be tolerated.

Preferably, the electrical contact is made from a pultruded composite member and may have a fibrillated brush-like structure at one end which provides a densely distributed filament contact with another component. By the term densely distributed filament contact it is intended to define an extremely high level of contact redundancy insuring electrical contact with another contact surface in that the contacting components has in excess of 1000 individual conductive fibers per square millimeter.

In accordance with a preferred embodiment of the invention, the use of a pultrusion of the type having a plurality of conductive fibers carried within a host matrix (sometimes referred to as a distributed fiber pultrusion) serving as electrical contacts is advanced. Rigid and sliding contacts employing this feature can be fabricated at very low cost. Due to the inertness and reliability of the distributed fiber contact, many new device configurations, which otherwise would have used metal contacts in open air and therefore would have been judged to be unreliable, can be now enabled. With the realization that a pultruded carbon material can be used as both a contact member and a structural component, it becomes apparent that these features can be combined into a multiple function device thereby enabling even higher value-added devices.

Such contacts can serve a variety of applications within a xerographic engine and its peripherals, all enabled by pultruded carbon fiber bars, tubes, rods or sheets which are ordinarily rigid but through laser cutting and heating can expose conductive regions that are flexible and can be easily contacted for electrical connections as below described in detail.

Thus, in accordance with the present invention, an improved electrical contact device is provided that is of improved reliability, is of low cost and is easily manufacturable. These advantages are enabled through the use of a manufacturing process known generally as a pultrusion process, with the fibrillation of at least one end of the pultrusion. One pultrusion composition that can be employed in practicing this invention is of the type that comprises continuous strands of resistive carbon fiber filler with a host polymer. Such carbon fiber pultrusions are a sub-category of high performance conductive composite plastics, and comprise one or more types of continuous, conductive reinforcing filaments in a binder polymer. They provide a convenient way to handle, process and use fine diameter, carbon fibers without the problems typically encountered with free conductive fibers.

The pultrusion process generally consists of pulling continuous lengths of fibers first through a resin bath or impregnator, then into a preforming fixture where the resulting section is at least partially shaped and excess resin and/or air are removed. The section is then pulled into heated dies where it is continuously cured. For a detailed discussion of pultrusion technology, reference is directed to Handbook of Pultrusion Technology" by Raymond W. Meyer, first published in 1985 by Chapman and Hall, N.Y.

More specifically, in the practice of the invention, conductive carbon fibers are submersed in a polymer bath and drawn through a die opening of suitable shape at high temperature to produce a solid piece having dimensions and shapes of that of the die. The solid piece can then be cut, shaped, or machined. As a result, a solid piece can be achieved that has thousands of conductive fiber elements contained within the polymer matrix, where the ends of the fiber elements can be exposed to provide electrical contacts. The very large redundancy and availability of electrical contacts enables a substantial improvement in the reliability of such devices.

Since the plurality of small diameter conductive fibers are pulled through the polymer bath and heated die as a continuous length, the shaped member can be formed with the fiber being continuous from one end of the member to the other. Accordingly, the pultruded composite may be formed in a continuous length during the pultrusion process, then cut to any suitable dimension, with a very large number of electrical contacts provided at each end. Subsequently such pultruded composite members may have either one or both of its ends fibrillated to remove some, or all, of the polymer from a given length of fiber.

Any suitable fiber having a suitable resistivity may be used in the practice of the invention. Typically, the conductive fibers are nonmetallic and have a DC volume resistivity of from about $1\times10^{-5}$ to about $1\times10^{+11}$ ohm-cm and preferably from about $1\times10^{-5}$ to about 10 ohm-cm to minimize losses and suppress RFI. The upper range of resistivities of up to $1\times10^{+11}$ ohm-cm could be used, for example, in those special applications involving extremely high fiber densities where the individual fibers act as individual resistors in parallel and to prevent arcing thereby lowering the overall resistance of the pultruded member while enabling current conduction. Higher resistivity materials may be used if the input impedance of the associated electronic circuit is sufficiently high. The vast majority of applications however, will require fibers having resistivities with in the above stated preferred range to enable efficient current conduction. The term "nonmetallic" is used to distinguish from conventional metal-wire fibers which exhibit metallic conductivity having resistivity of the order of $1\times10^{-6}$ ohm-cm and to define a class of fibers which are nonmetallic but can be treated in ways to approach or provide metal like properties. However, carbon fibers are particularly well suited as the preferred fiber because they are chemically and environmentally inert, possess high strength and stiffness, can be tailored to virtually any desired resistivity, and exhibit a negative coefficient of thermal resistivity. Further, they are easily compounded with a wide variety of thermoplastic and thermosetting resins into high strength pultrusions.

In addition, the individual conductive fibers can be made circular in cross section with a diameter generally in the order of from about 4 micrometers to about 50 and preferably from about 5 micrometers to 10 micrometers. This provides a very high degree of fiber redundancy in a small cross sectional area. Thus, as contact materials, the large number of fibers provide a multiple redundancy of contact points, for example, in the range between about $0.05\times10^{+5}$ and $5\times10^{+5}$contacts/cm$^2$. This is believed to enable ultrahigh contact reliability. It should be appreciated that blends of fibers having different sizes are possible.

The fibers are typically flexible and compatible with the polymer systems within which they are carried. Typical fibers may include carbon, carbon/graphite, metalized or metal coated carbon fibers, metal coated glass, and metal coated polymeric fibers. A particularly preferred class of fibers that may be used are those fibers that are obtained from controlled heat treatment process to yield complete or partial carbonization of polyacrylonitrile (PAN) precursor fibers. It has been found for such fibers that by carefully controlling the temperature of carbonization within certain limits that precise electrical resistivities for the carbonized carbon fibers may be obtained. The carbon fibers from polyacrylonitrile (PAN) precursor fibers are commercially produced by Graphil, Inc., Amoco Performance Products, Inc., and others in yarn bundles of 1,000 to 160,000 filaments commercially referred to as "Tows." Metal plated carbon fibers are available from Novamet Specialty. The Tows are typically carbonized in a two-stage process. The first stage involves stabilizing the PAN fibers at temperatures of the order of 300° C. in an oxygen atmosphere to produce preox-stabilized PAN fibers. The second stage involves carbonization of the fibers at elevated temperatures in an inert atmosphere, such as an atmosphere containing nitrogen. The DC electrical resistivity of the resulting fibers is controlled by the selection of the temperature and time of carbonization. For example, carbon fibers having an electrical resistivity of from about $10^2$ to about $10^6$ ohms-cm are obtained if the carbonization temperature is controlled in the range of from about 500° C. to 750° C., while carbon fibers having D.C. resistivities of $10^{-3}$ to about $10^{-5}$ ohm-cm result from treatment temperatures of 1800° to 2000° C. For further reference to the processes that may be employed in making these carbonized fibers, attention is directed to U.S. Pat. No. 4,761,709 to Ewing et al and the literature sources cited therein at column 8. Typically, these carbonized fibers have a tensile modulus of from about 30 million to 60 million psi or 205 to 411 GPa which is higher than many metals thereby enabling a very strong pultruded composite member. The highest temperature conversion of the polyacrylonitrile fibers results in a fiber which is about 99.99% elemental carbon which is inert and will resist oxidation.

One of the advantages of using conductive carbon fibers is that they have a negative coefficient of thermal conductivity so that as the individual fibers become hotter with the passage of, for example, a spurious high current surge, they become more conductive. This provides an advantage over metal contacts as the coefficient of thermal conductivity of metals operate in just the opposite manner and therefore metal contacts tend to burn out or self destruct. The carbon fibers have the further advantage in that their surfaces are inherently rough and porous thereby providing good adhesion to the polymer matrix. In addition, the inertness of the carbon material yields a contact surface relatively immune to the typical contaminants of that affected metal. The carbon fibers are enclosed in any suitable polymer matrix. The polymer matrix should be of a resin binder material that will volatilize rapidly and cleanly upon direct exposure to the laser beam during laser processing below described. Polymers such as low molecular weight polyethylene, polypropylene, polystyrene, polyvinylchloride, and polyurethane may be particularly advantageously employed. Polyesters, epoxies, vinyl esters, polyetheretherketones, polyetherimides, polyethersulphones and nylon are in general, suitable materials with the cross-linkable polyesters and vinylesters being preferred due to their short cure time, relative chemical inertness and suitability for laser processing.

A laser (not shown) can be used to both cut individual components for use as electrical contacts. For example, a focused $CO_2$, 500 watt, continuous wave laser can be used to cut the pultrusion and simultaneously volatilize the binder resin in a controlled manner for a sufficient distance back from the cut to produce in one step a distributed filament contact. The length of exposed carbon fiber can be controlled by the laser power, position of focus and cut rate. Various cut edge shapes can be achieved by changing the laser incidence angle.

Thus, a suitable pultrusion can be cut by laser techniques to form a contact of desired length from the longer pultrusion length, and both severed ends can be fibrillated to provide a high redundancy fiber contact member downstream for contact to electrically circuitry to be powered, biased, grounded or switched, and a high redundancy fiber contact upstream to contact a power source, ground potential, switch, or sensor contact plate. Any suitable laser can be used whose energy will be absorbed by the matrix of the host polymer, so that the host polymer will be volatilized. Specific lasers which may be used include a carbon dioxide laser, carbon monoxide laser, the YAG laser, or the excimer laser. The carbon dioxide laser mentioned is particularly suited for this application, since it is highly reliable, well suited for polymer matrix absorption, and is highly economical in manufacturing environments.

Figure 4:
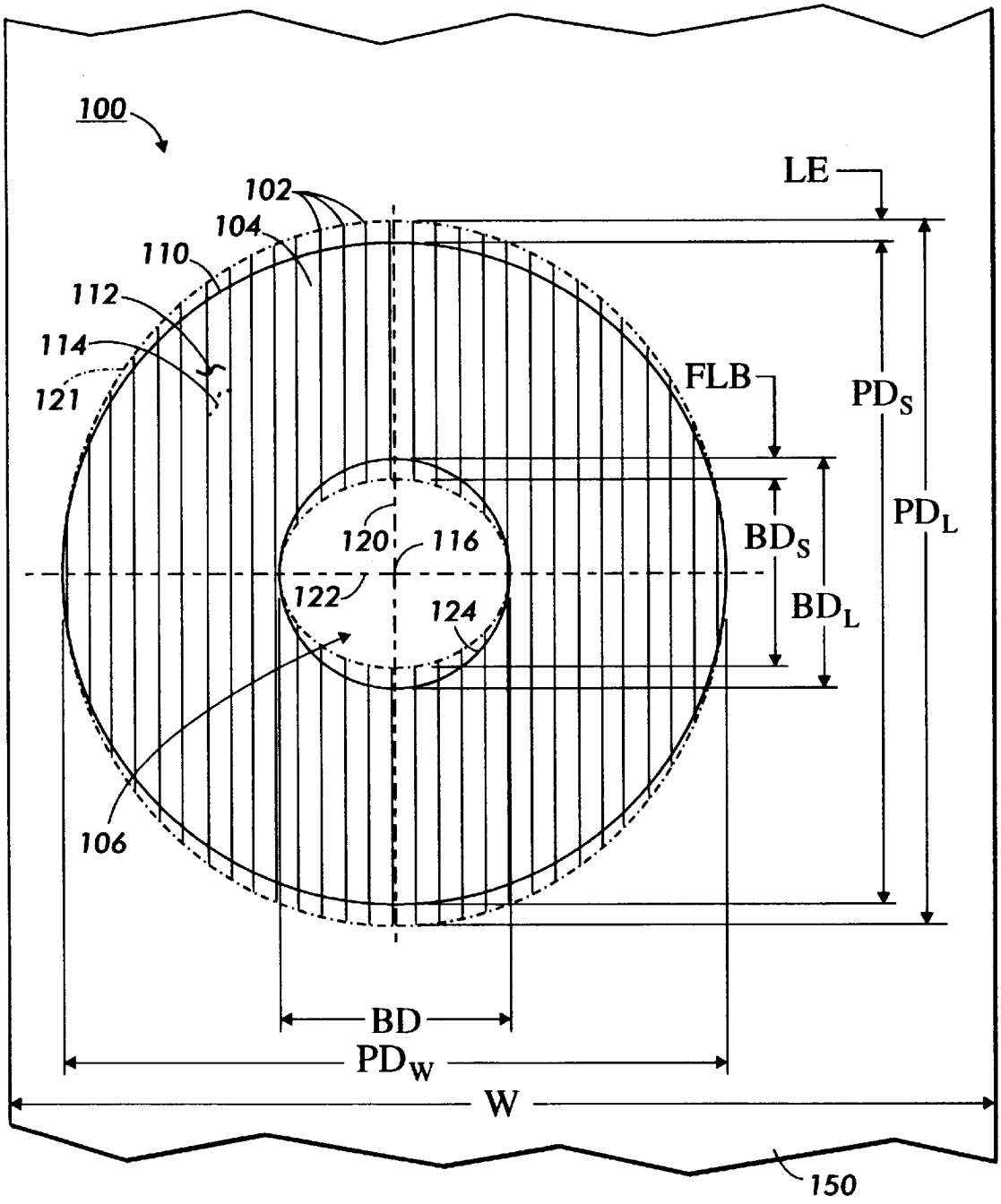
FIG. 4 is a plan view of a blank used to manufacture the device of FIG. 1 showing the cutter path for manufacturing in phantom.

According to the present invention and referring to FIG. 1, a carbon fiber electrical contact 100 in the form of a washer is shown, which is cut from the blank 101, as shown in FIG. 4. As described in greater detail earlier, the electrical contact 100 is made from a pultruded composite member and has fibrillated brush like structure on the bore or inner diameter 124. The brush like structure provides a densely distributed filament contact with the shaft or other mating component. The composite member includes a plurality of conductive fibers 102 which are carried within a host matrix 104. The host matrix 104 together with the conductive fibers 102 may also be called a distributed fiber pultrusion. The fibers 102 may be carbonized polyacrylonitrile (PAN) fibers.

The electrical contact 100 may have any suitable shape and corresponding features shown herein to include an aperture 106 therein for an electrical contact with a rotating member, for example, a shaft, (not shown). The electrical contact 100 also includes an outer periphery 110 thereof. While the electrical contact may have any suitable shape, preferably, the contact 100 is preferably in the form of a washer having first and second parallel faces 112 and 114 parallel spaced apart and perpendicular to centerline axis 116 of aperture 106.

Electrical contact may be had between the contact 100 and the housing (not shown) in any suitable fashion. For example, the electrical contact 100 may be in contact with the housing against either surface 112 or surface 114. Alternatively, the electrical contact 100 may have contact with the housing along the outer periphery 110. Preferably, however, electrical contact between the contact 100 and the housing occurs with fibers 102 in contact with the housing. It should be appreciated that alternatively, the electrical contact may be had by the use of a piercing contact (not shown) to pierce into the electrical contact 100 and thereby contacting a plurality of the fibers 102.

Referring again to FIG. 1, the fibers 102 in the matrix 104 are aligned in a parallel direction along fiber axis 120. Since the fibers 102 have a decomposition temperature above that of matrix 104, heat may be applied to the contact 100 at any suitable location to expose the fibers 102 from the matrix 104. These fibers 102, when heated along the periphery 110, may thus contact the housing thereby improving the electrical contact therebetween.

Similarly, the fibers 102 may be exposed from the matrix 104 about the aperture 106 thereby improving the electrical contact between the contact 100 and the rotating member.

The electrical contact 100 may be made in any suitable process capable of manufacturing the pultruded carbon fiber electrical contact of the present invention as described herebefore. Preferably, however, the material is pultruded in sheets in the direction of axis 120. The sheets have a thickness equal to the thickness of the contact, say, for example, 0.5 to 5.0 mm.

The pultruded sheets of carbon fiber plus matrix material are cut into a shape having a central aperture 106 in any suitable fashion. Preferably, the cut surface will include the electrical contact surface without further processing or modification. Thus, the properties of the desired electrical contact are enabled by the cutting method selected. For example, the electrical contacts may be cut using a water jet or a laser. The use of a water jet or an excimer laser will minimize the decomposition of the matrix 104 during cutting of the pultrusion, while the use of a $CO_2$ or CO laser particularly when translating at slow translational speeds may cause a considerable amount of heating, decomposition, and vaporization of the matrix and thereby exposing the fibers 102.

Referring to FIG. 4, by utilizing a $CO_2$ CO, or other laser cutting device or a similar heat generating cutting device mounted on a machine capable of generating a cutting path 121, for example, a contoured numerical control (CNC) machine which is commercially available. The electrical contact 100 can be cut from a long continuous blank 150 having a width W slightly wider than the contact 100. The cutting path 121 can be provided to define outer periphery 110 of the electrical contact 100. The outer periphery 110 defines an elliptical path having a diameter $PD_L$ along fiber axis 120 and a smaller diameter $PD_W$ along perpendicular axis 122 which is perpendicular to fiber axis 120. The laser cutting device (not shown) is translated very quickly adjacent the perpendicular axis 122 providing for very little decomposition of the matrix 104 and progressively translates slower to its slowest translation point at axis 120. The fibers 102 thus have an exposed length LE which is almost zero adjacent the perpendicular axis 122 and has its maximum length along fiber axis 120. The laser cutting tool is translated along outer periphery 110 at a continuously increasing translational speed from the fiber axis 120 to the peripheral axis 122 and correspondingly around the entire outer periphery 110 of the contact 100. The laser thus cuts the matrix 104 into an elliptical outer shape defined by diameter $PD_W$ along the peripheral axis 122 and a diameter $PD_S$ along fiber axis 120. The electrical contact 100 thus is suitable for positioning into a housing having a bore with a diameter between diameter $PD_W$ and diameter $PD_L$ so that the fibers 102 are flexed into contact with the housing thereby providing sufficient electrical contact.

Similar to the outer periphery 110, the aperture 106 is preferably cut with a laser. The laser preferably translated at a fast translational speed adjacent the peripheral axis 122 ended in much slower translational speed adjacent the fiber axis 120 in order to expose the fibers 102 adjacent the fiber axis 120. The aperture 106 is formed by translating the laser in an elliptical path defined by diameter BD along perpendicular axis 122 and $BD_S$ along fiber axis 120. The fibers 102 are thus exposed increasingly to a maximum fiber length FLB adjacent the fiber axis 120. The laser decomposes and vaporizes the matrix 104 so as to form a matrix bore 124 defined by diameter BD at the peripheral axis and diameter $BD_L$ at the fiber axis. The aperture 106 is thus compatible with a rotating member having size between diameter BD and diameter $BD_S$. The fibers 102 are in a flexed and contact position with the rotating member as illustrated in FIG. 1.

Referring again to FIG. 1, preferably, to permit passage of contamination in the direction of axis 116, the contact 100 includes channels 126 positioned preferably adjacent perpendicular axis 122. The channels 126 may have any particular shape and may for example have an arcuate shape. The position of the channels 126 adjacent the perpendicular axis 122 is preferred in that the fibers 102 at the positions along the perpendicular axis 122 are aligned such that they cannot effectively serve as brushes for contact with the rotating member.

According to the present invention and referring to FIG. 1, the electrical contact 100 is shown in position between a first element 130 in contact with outer periphery 110 of the electrical contact 100 and a second rotating element 132 located within aperture 106 of the electrical contact 100. The first element 130 may be any element to which electrical contact with the rotating element 132 is desired. The first element 130 may be in the form of a housing or structure which includes a bore 134 therein. The bore 134 is defined by a bore diameter B. The outer periphery 110 of the contact 100 is matingly fitted to the bore 134. A protrusion (not shown) may be used to avoid relative rotation between the first element 130 and the electrical contact 100.

Alternatively, the first element 130 may be in the form of a rotating element rotating in the direction of arrow 136 at a first rotational speed $\Omega_1$. The second element 132 may likewise rotate in the direction of arrow 140 at a second rotational speed $\Omega_2$. The electrical contact 100 is suitable for providing contact where the first element 130 and the second 132 rotate in either different rotational speeds in the same direction or in rotations of opposite direction.

Figure 5B:
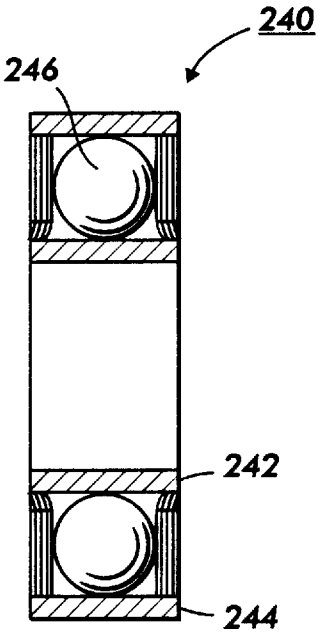
FIG. 5B is an end view of the device of FIG. 5A.
Figure 5A:
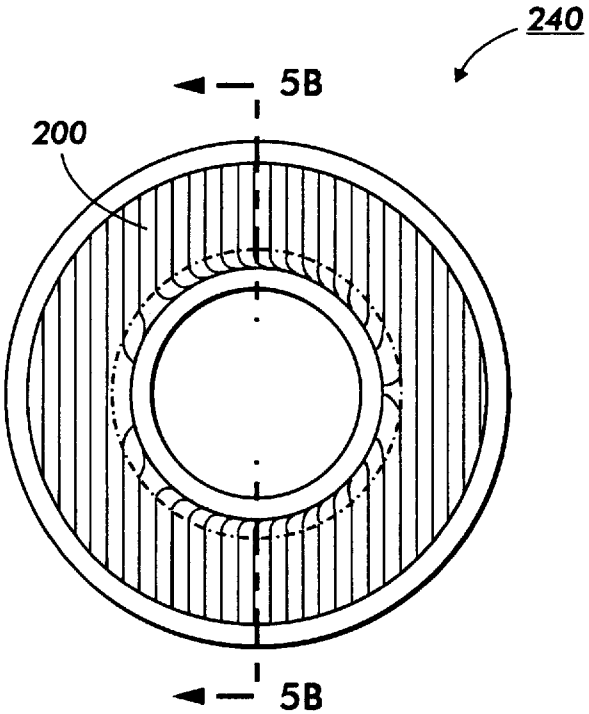
FIG. 5A is a schematic elevational view of a bearing incorporating the device having a multiplicity of electrically conductive fibers extending in a parallel direction for transferring electrical charge of the present invention.

Referring now to FIGS. 5A and 5B, an alternate embodiment of the electrical contact 100 is shown in electrical contact 200 which represents part of bearing 240. The bearing 240 includes inner race 242 and outer race 244 separated by rolling elements 246 in the form of bearing balls. A retainer (not shown) is typically used to locate and separate the balls 246. The electrical contact 200 may, as shown in FIGS. 5A and 5B, be circular or round in shape and substituted for a seal normally used to seal the lubricant within a bearing and to prevent contamination from entering the bearing. The exposed fibers 202 contact the outer diameter of the inner race 242 providing the electrical contact between the outer race 244 and the inner race 242. While as shown in FIGS. 5A and 5B, a pair of electrical contacts 200 are used, it should be appreciated that a solitary electrical contact 200 may be used in conjunction with a standard seal to enclose the bearing 240.

Figure 2B:
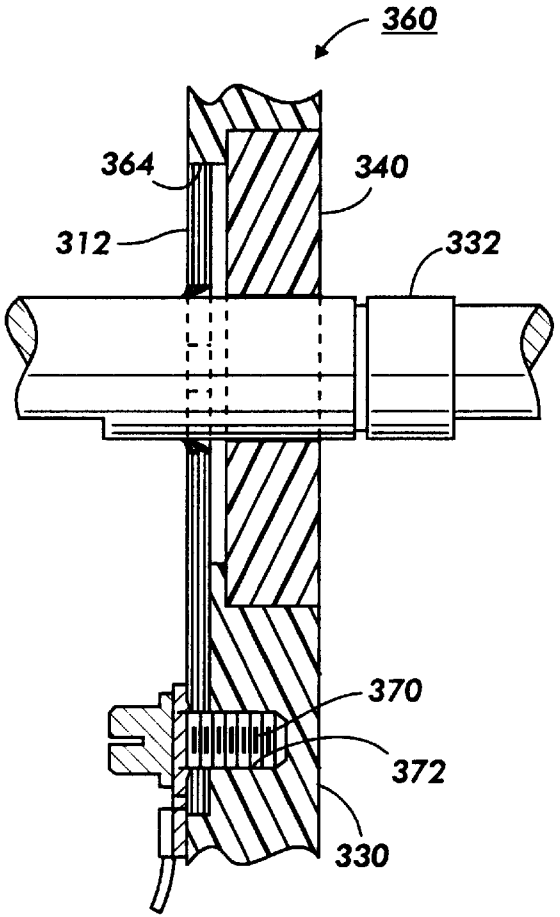
FIG. 2B is an end view of the device of FIG. 2A.
Figure 2A:
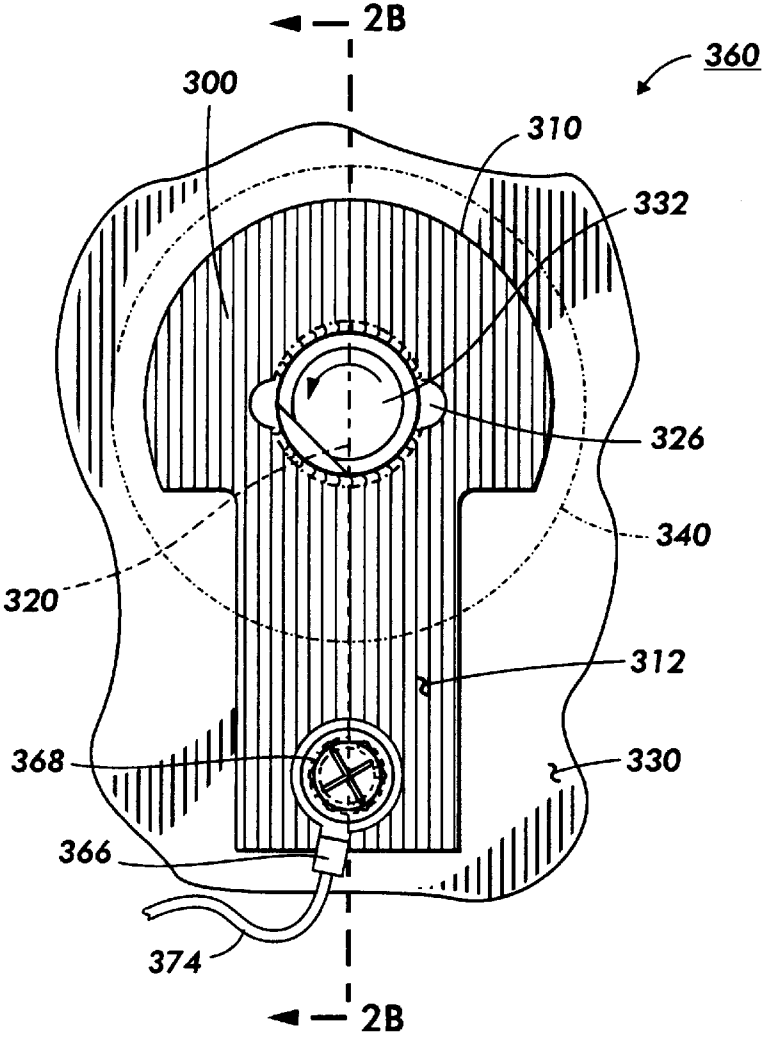
FIG. 2A is a plan view of a first embodiment of the device of FIG. 1 for use to transfer charge from an electrical conduit to a rotating member.

Referring now to FIGS. 2A and 2B, an alternate embodiment of the present invention is shown in electrical contact 300 for use in mounting system 360 for mounting a shaft 332 within a housing 330. Electrical contact 300 is similar to electrical contact 100 of FIG. 1 except that electrical contact 300 has an outer periphery 310 which is different from outer periphery 110 of the electrical contact 100 in that outer periphery 310 has a non-circular portion. The outer periphery 310 fits into cavity 364 of the housing 330. The outer periphery 310 does not require the use of exposed fibers. Instead, an electrically conductive connector 366 is used to contact first face 312 of the electrical contact 300. The electrical conductive conductor preferably includes protrusions (not shown) to pierce the first surface 312 of the electrical connector 300. The connector 366 is electrically connected to the housing 330 in any suitable fashion such as by a fastener 368 in the form of a screw with which external threads 370 matingly engage with internal threads 372 on the housing 330. The electrically conductive connector 366 preferably further includes an electrical conduit 374 which is connected to the power supply (not shown) for providing the electrical bias. The shaft 332 is positioned rotatably within the housing 330 by any suitable feature, i.e. by bearing 340. Bearing 340 may be an inexpensive, electrically nonconductive bearing made of a synthetic material. The use of the electrical contact 300 permits the use of a less expensive non-electrically conductive material for bearing 340. The electrical contact 300 preferably includes channels 326 positioned opposed to fiber axis 320.

Figure 3A:
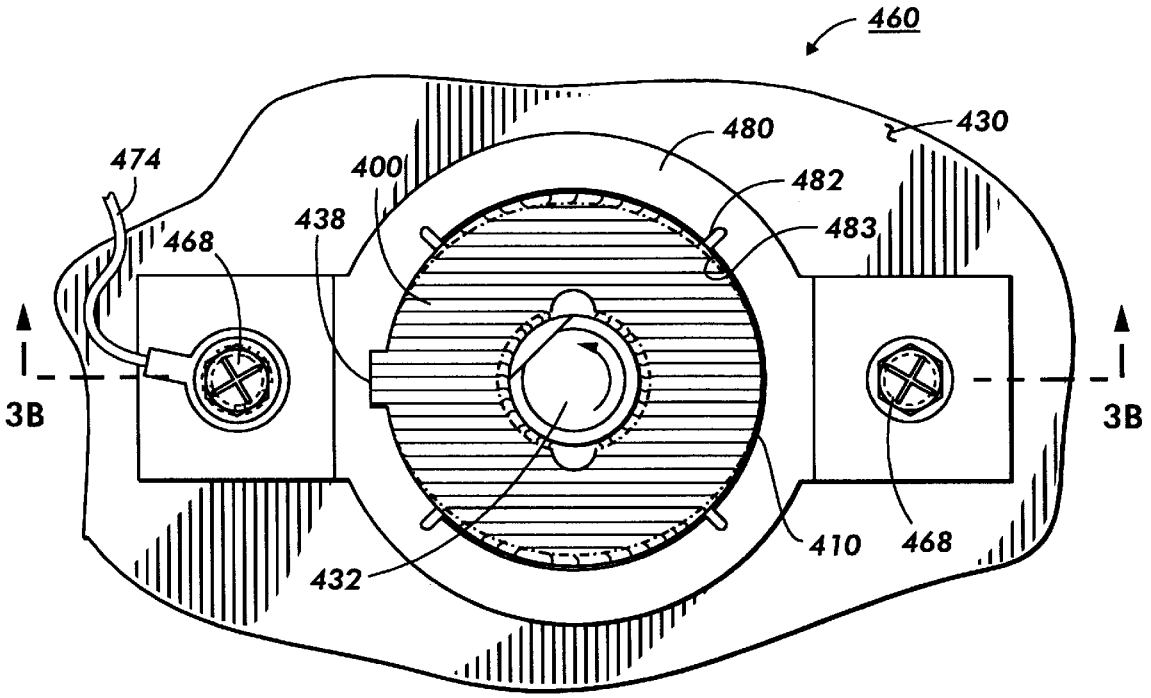
FIG. 3A is a partial plan view of a second embodiment of the device of FIG. 1 for use to transfer charge from an electrical conduit to a rotating member.
Figure 3B:
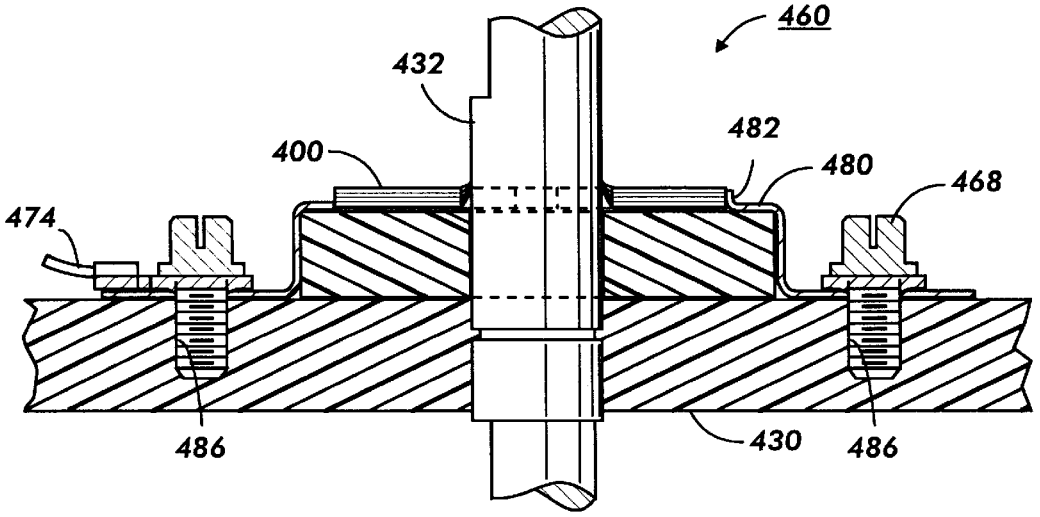
FIG. 3B is an end view of the device of FIG. 3A.

Referring now to FIGS. 3A and 3B, a mounting system 460 is shown utilizing electrical contact 400 according to the present invention. Electrical contact 400 is similar to contact 100 of FIG. 1 except that contact 400 includes a protrusion 438 to prevent rotation of the contact 400. The contact 400 is secured to housing 430 by use of an electrically conductive metallic strip 480. The strip 480 includes a large bore 483 to which the contact 400 is matingly secured. Tabs 482 in the strip secure the contact 400 to the strip 480. The strip 480 includes a pair of holes 486 through which fasteners in the form of screws 468 are slidingly fitted. The screws 468 are used to mount the strip 480 into housing 430. The electrical contact 400 serves to transfer charge from electrical contact conductor 474 through the strip 480 and to shaft 432.

By providing a carbon fiber electrical contact in a polymer matrix having a bore therein with a plurality of flexible electrically conductive fibers, a simple, inexpensive and extremely durable electrical contact for a rotating element may be provided.

By providing an electrical contact in the form of a washer-shaped carbon fiber contact in a polymer matrix having channels adjacent the bore of the washer-shaped contact, a path can be provided for the passage of contaminants.

By providing a carbon fiber electrical contact with exposed fibers providing an inner periphery thereof smaller than the diameter of the rotating element, a robust electrical contact can be provided.

By providing a carbon fiber electrical contact in the shape of a washer having an outer periphery thereof with exposed fibers, a robust electrical contact can be made between the electrical contact and an exterior rotating member or a fixed housing.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A device for transferring electrical charge from first element to a second element having relative rotational motion therebetween, said device comprising:

a body comprising a pultruded composite member including a multiplicity of electrically conductive fibers, the plurality of conductive fibers being oriented in a longitudinal direction of the pultruded composite member, said fibers each extending in a substantially parallel direction, parallel to a first axis, said body including a first contact area, said body including a second contact area spaced from the first contact area, the first contact area for contact with the first element and the second contact area for contact with the second element, the second element having an external periphery thereof closely conforming to the second contact area, said body defining a relief area positioned adjacent the second contact area and extending into said body.

2. The device according to claim 1:

wherein the conductive element comprises a bearing outer race;

wherein the rotating element comprises a bearing inner race; and wherein said body comprises an electrically conductive seal for sealing a cavity formed between the bearing inner race and the bearing outer race.

3. The device according to claim 2 further comprising a second electrically conductive seal opposed to said first mentioned seal, said first mentioned seal and said second seal cooperating to seal a cavity formed between the bearing inner race and the bearing outer race.

4. The device according to claim 1, wherein the exposed length of each of the plurality of conductive fibers which form a brush structure being between about 1 micrometer and about 15 millimeters.

5. The device according to claim 1, wherein said body comprises at least one fibrillated portion including a brush structure of filament contacts formed from an exposed length of the plurality of conductive fibers for contact with at least one of the first element and the second element.

6. The device according to claim 1, further comprising a support secured to said body for supporting said body.

7. The device according to claim 6, wherein said first element is integral with said support.

8. The device according to claim 1, further comprising a second relief area spaced from said first mentioned relief area and extending into said body.

9. The device according to claim 1 wherein the relief area extends into said body a distance of greater than 0.1 mm and less than 10 mm.

10. The device according to claim 1, wherein said body comprises a plate having a cylindrical outer periphery.

11. The device according to claim 10, wherein said plate has a thickness of greater than 0.1 mm and less than 10 mm.

12. The device according to claim 1, wherein said electrically conductive element comprises a terminal attached to said body, the electrical charge being transferred through said terminal to said body.

13. The device according to claim 1, wherein at least one of said first contact area and said second contact area have been prepared by at least one of the methods of laser cutting, heating and waterjet cutting.

14. A bearing for rotatably supporting a member in a housing and for transferring electrical charge between the housing and the member, said bearing comprising:

a bearing outer race secured to said housing;

a bearing inner race, rotatably secured to said outer race and secured to said member; and a seal comprising a pultruded composite member including a multiplicity of electrically conductive fibers provided with a polymer matrix, the plurality of conductive fibers being oriented within the polymer matrix in a longitudinal direction of the pultruded composite member, said fibers each extending in a substantially parallel direction, parallel to a first axis, said seal including a first contact area on the outer periphery thereof, said seal defining an aperture therein, said seal including a second contact area on the periphery of the aperture, said outer race cooperating with the first contact area and said inner race cooperating with the second contact area to transfer electrical charge between the housing and the member.

15. The bearing according to claim 14, wherein the exposed length of each of the plurality of conductive fibers which form a brush structure being between about 1.0 micrometer and about 15 millimeters.

16. The bearing according to claim 14, wherein said body comprises at least one fibrillated portion including a brush structure of filament contacts formed from an exposed length of the plurality of conductive fibers for contact with the surface a multiplicity of electrically conductive fibers.

17. The bearing according to claim 14, wherein the aperture has a substantially cylindrical shape.

18. The bearing according to claim 14, wherein the aperture defines:

a substantially cylindrical portion thereof; and a relief area extending outwardly from the cylindrical portion of the aperture.

19. The bearing according to claim 18, further comprising a second relief area extending outwardly from the cylindrical portion of the aperture.

20. The bearing according to claim 18 wherein the relief area extends inwardly from the cylindrical portion a distance of greater than 0.1 mm and less than 10 mm.

21. The bearing according to claim 14, wherein; said body comprises a plate having a cylindrical outer periphery.

22. The bearing according to claim 21, wherein said plate has a thickness of greater than 0.1 mm and less than 10 mm.

23. A printing apparatus, including first element and a second element having relative rotational motion therebetween, said printing apparatus including a device for transferring electrical charge from the first element to the second element, said device comprising:

a body comprising a pultruded composite member including a multiplicity of electrically conductive fibers, the plurality of conductive fibers being oriented in a longitudinal direction of the pultruded composite member, said fibers each extending in a substantially parallel direction, parallel to a first axis, said body including a first contact area, said body including a second contact area spaced from the first contact area, the first contact area for contact with the first element and the second contact area for contact with the second element, the second element having an external periphery thereof closely conforming to the second contact area, said body defining a relief area positioned adjacent the second contact area and extending into said body.

24. The printing apparatus according to claim 23:

wherein the conductive element comprises a bearing outer race;

wherein the rotating element comprises a bearing inner race; and wherein said body comprises an electrically conductive seal for sealing a cavity formed between the bearing inner race and the bearing outer race.

25. The printing apparatus according to claim 24 further comprising a second electrically conductive seal opposed to said first mentioned seal, said first mentioned seal and said second seal cooperating to seal a cavity formed between the bearing inner race and the bearing outer race.

26. The printing apparatus according to claim 23, wherein the exposed length of each of the plurality of conductive fibers which form a brush structure being between about 1 mircometer and about 15 millimeters.

27. The printing apparatus according to claim 23, wherein said body comprises at least one fibrillated portion including a brush structure of filament contacts formed from an exposed length of the plurality of conductive fibers for contact with at least one of the first element and the second element.

28. The printing apparatus according to claim 23, further comprising a support secured to said body for supporting said body.

29. The printing apparatus according to claim 28, further comprising a second relief area spaced from said first mentioned relief area and extending into said body.

30. The printing apparatus according to claim 28, wherein said first element is integral with said support.

31. The printing apparatus according to claim 23 wherein the relief area extends into said body a distance of greater than 0.1 mm and less than 10 mm.

32. The printing apparatus according to claim 23, wherein said body comprises a plate having a cylindrical outer periphery.

33. The printing apparatus according to claim 32, wherein said plate has a thickness of greater than 0.1 mm and less than 10 mm.

34. The printing apparatus according to claim 23, wherein said electrically conductive element comprises a terminal attached to said body, the electrical charge being transferred through said terminal to said body.

* * * * *